United States Patent [19]

Burchette, Jr.

[11] 4,181,274

[45] Jan. 1, 1980

[54] DYE TUBE

[76] Inventor: Robert L. Burchette, Jr., 151 Fernwood Dr., Spartanburg, S.C. 29302

[21] Appl. No.: 734,830

[22] Filed: Oct. 22, 1976

[51] Int. Cl.[2] ..... B65H 75/20

[52] U.S. Cl. ..... 242/118.11

[58] Field of Search ..... 242/118.11, 118.1, 118.2; 68/198

[56] References Cited

U.S. PATENT DOCUMENTS

| | | | |
|---|---|---|---|
| 3,465,984 | 9/1969 | Tigges et al. | 242/118.11 |
| 3,827,652 | 8/1974 | Burchette, Jr. | 242/118.11 |
| 3,929,301 | 12/1975 | Frank et al. | 242/118.11 |

FOREIGN PATENT DOCUMENTS

| | | | |
|---|---|---|---|
| 2408949 | 9/1975 | Fed. Rep. of Germany | 242/118.11 |

*Primary Examiner*—George F. Mautz

*Attorney, Agent, or Firm*—Wellington M. Manning, Jr.; Luke J. Wilburn, Jr.

[57] ABSTRACT

A yarn carrier is described and claimed herein suitable for use for winding textile yarn thereon and dyeing same at full length or while the carrier is in a collapsed condition. In the collapsed condition, adequate and uniform dye flow from the inside of the tube outwardly is permitted to evenly dye the yarn wound thereon. A tube having terminal flanges or rings is provided with an initially rigid intermediate structure that has an open network to permit passage of dye therethrough and that is capable of axial compression with respect to the length of the tube upon receipt of a predetermined amount of force. Axially extending rigid members are provided throughout the intermediate tube structure to provide the initially rigid tube with at least certain of the axial rigid members being deformable when subjected to sufficient axial force with respect to the tube to deflect or rupture and thus permit axial collapse of the tube. The internal structure of the tube may include rings, helical leads or the like and may further include additional axially extending rigid members that are not deformable by the predetermined axial force on the tube.

18 Claims, 12 Drawing Figures

DYE TUBE

BACKGROUND OF THE INVENTION

Dye springs have been utilized for many years as cores onto which textile yarn is wound for dyeing. Though the generic terminology dye spring is utilized, it should be pointed out that the terminology is intended to refer not only to helical springs of stainles steel and the like, but also to various and sundry dye tubes that serve as cores for textile yarn and are thereafter received on a dye spindle or the like in a pressurized vessel where dyestuff passes upwardly through the inside of the core and diffuses outwardly through the yarn wound thereon.

Various attempts have been made to improve dye springs in the sense of producing a spring or tube that does not require the use of a filter paper sleeve between the tube or spring and the yarn wound thereon. It has generally been determined, however, that for proper diffusion of dyestuff through the yarn, the filter paper sleeve is greatly preferred for certain yarns. In this sense, certain dye tubes that may or may not be collapsible in an axial direction have heretofore been produced where contentions were made that the tubes would not require the use of the filter paper sleeve. Yet, for the best utilization of the tube, use of the filter paper has prevailed to preclude the passage of globs of dyestuff through a particular portion of the tube and to reduce yarn entrapment during tube collapse.

Furthermore, it has been determined that a collapsible dye tube may be provided which, when wound with yarn and placed in the dye kettle, may be collapsed or axially compressed by a limited amount to enable a greater quantity of yarn to be placed in the dye kettle during a single dyeing cycle. Stainless steel dye springs have been utilized for this particular purpose, as have springs and tubes of other construction, such as those molded from thermoplastic polymeric materials.

Certain problems exist with respect to the stainless steel dye springs and to variations of same. Such disadvantageous problems involve the capital expenditure required for maintaining an adequate supply of the springs, and the reworking, cleaning and the like of the springs to enable them to be reused, to mention a few. In view of these characteristics, effort has further been expended in the area of production of a molded, thermoplastic, collapsible dye spring that is disposable after a single use. In other words, once the dye spring has been wound with yarn and the yarn dyed, the yarn is wound off the tube and the tube is discarded.

The present invention provides yet another improvement in the area of dye tubes or dye springs. A definite improvement over the prior art is found in the present dye spring which may be manufactured sufficiently economically to enable successful commercialization and use of same. Thereafter, instead of reusing the tube, the tube is discarded and new tubes are substituted therefor. The present dye spring is believed to be suitable for use on all types of winders which heretofore presented somewhat of a problem due to different means of handling the tubes on certain of the various winders. Further, the present dye tube may be utilized as a rigid tube or as a collapsible tube. Due to the structure of the present tube, other uses are also available outside the textile industry. For example, the tubes may be employed in certain other environs as springs, shock absorbers or the like.

The present invention is neither taught nor suggested by any known prior art.

SUMMARY OF THE INVENTION

It is an object of the present invention to provide a molded tubular element that is initially rigid but is capable of axial compression upon receipt of a predetermined axial force.

Another object of the present invention is to provide an improved disposable, dye spring that may be employed as a rigid tube or a collapsible tube.

Still another object of the present invention is to provide an improved dye spring that is initially rigid and may be collapsed when received in a pressurized dye vessel and a predetermined pressure is applied thereon in an axial direction with respect to the length of the spring.

Generally speaking, the dye tube of the present invention comprises a pair of annular flanges, and an intermediate structure located between said annular flanges, said intermediate structure comprising at least one member extending generally transverse to the length of the tube and a plurality of rigid members extending generally axially to the length of the tube, said members being secured together to initially define a rigid structure having an open network, at least certain of said rigid axially extending members being deformable by an axial force of a predetermined amount to cause axial compression of said tube.

More specifically, the tubular element of the present invention in one of its most preferrred forms comprises an annular flange at each end of the element with generally transversely extending members, either in the form of a plurality of rings or at least one helical element secured between the flanges and a plurality of axially extending rigid members secured at opposite ends to adjacent rings or segments of a helical element to define an initially rigid structure with at least certain of the rigid axial elements being deformable upon receipt of a predetermined pressure to permit axial compression of the tube.

In a preferred embodiment, two kinds of rigid axially extending members are used. A first rigid member is nondeformable with each nondeformable rigid member being spaced apart from an adjacent nondeformable member in axial and transverse directions (either circumferential or helical). A second rigid member is deformable upon receipt of a predetermined pressure and thereby converts the tube to a collapsible tube once the pressure has been received. Interspacing of first and second rigid members permits a limited collapse of the tube and insures adequate openness of the tube wall to permit the flow of dye liquor therethrough after tube collapse.

The deformable rigid members may upon receipt of the predetermined pressure deflect from an axial disposition, or the member may rupture at a predetermined location to permit tube collapse, and the term deformable is used throughout herein to include any such types of change.

A dye tube according to the present invention thus includes a structure where an initial rigid path extends along the full length of the tube with at least certain of the rigid axial elements along the path being deformed upon receipt of the predetermined pressure to permit limited collapse of the tube. In those situations where only deformable rigid members are utilized, the members themselves limit collapse of the tube while in an embodiment where nondeformable rigid members are employed, the nondeformable members also serve to limit axial collapse of the tube.

The generally transversely extending members utilized in manufacturing the tubular element of the present invention are preferably generally trapezoidal in cross section while the nondeformable rigid members are preferably generally rectangular. As such, a greater resistance to any transverse or radial compression is experienced along with better moldability of the dye tube.

DESCRIPTION OF THE PREFERRED EMBODIMENTS

Figure 1:
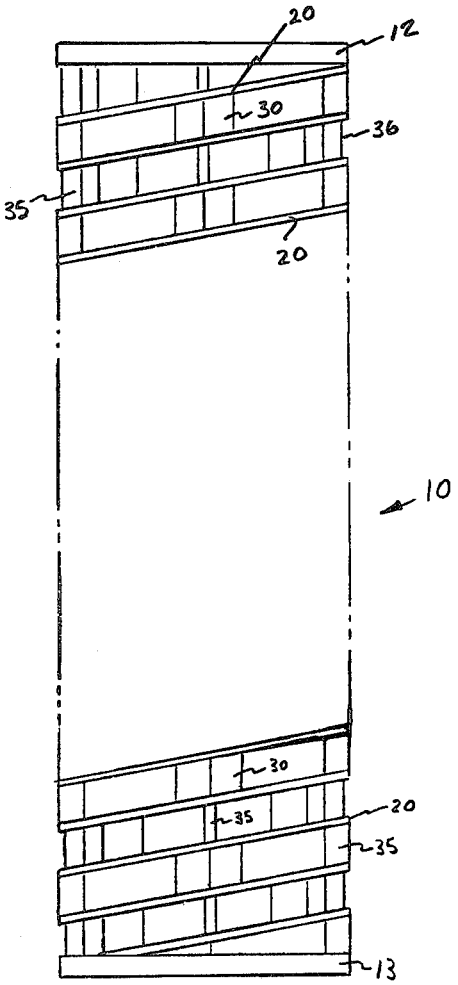
FIG. 1 is a side elevational view of a tubular element according to the teachings of the present invention.
Figure 2:
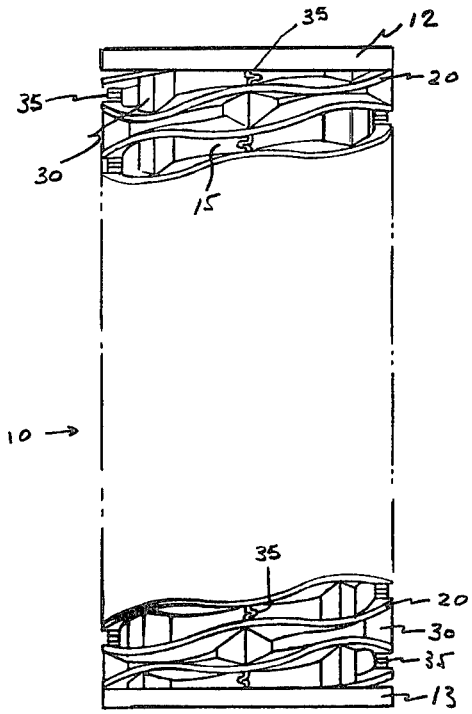
FIG. 2 is a side elevational view of the tube of FIG. 1 shown in a compressed state.
Figure 3:
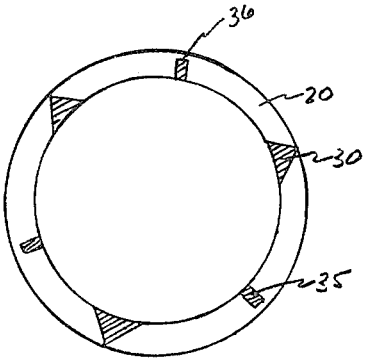
FIG. 3 is a horizontal cross sectional view of the tube of FIG. 1 taken along a line III—III.

Referring to the Figures, preferred embodiments of the present invention will now be described in detail. FIGS. 1, 2 and 3 illustrate an embodiment of the tubular element of the present invention that may be employed as a core around which textile strand may be wound for dyeing. Such cores are commonly referred to dye springs, dye tubes and the like, and the terms are used interchangeably herein. The core generally indicated as 10 is provided with a pair of annular end flanges 12 and 13 and has at least one helical lead 20 positioned between end flanges 12 and 13 and secured at opposite ends thereto. At least one helical lead or member 20 is thus secured to end flange 12 and follows a helical path of a predetermined pitch downwardly to and is connected to opposite end flange 13. End flanges 12 and 13 are of sufficient dimensions as to size, width and length to be suitably accepted by a textile strand winder where yarn will be properly wound around the dye tube. Flanges 12 and 13 are futher preferably circular in shape, though other shapes are acceptable. Likewise, the helical lead 20 is designed to have a predetermined pitch, size and cross section. Performance characteristics of lead 20 are designed to have a predetermined pitch, size and cross section. Performance characteristics of lead 20 are instrumental in winding from a rigidity standpoint, in dyeing from a rigidity and compressibility standpoint and in molding from an ease of moldability standpoint. Leads 20 may be designed to lessen the need for filter paper around the dye tube. In this light, the larger the lead angle or the greater the pitch of leads 20, the less chance for entrapment during compression of the tube.

Lead 20 or leads 20, if a plurality are employed, have first rigid members 30 disposed therealong. Members 30 are secured to lead sections and are disposed generally perpendicular to flanges 12 and 13 and angular with respect to lead 20. Further, second rigid members 35 are also provided, being secured at opposite ends to leads 20. First rigid members 30 are spaced apart from each other in both helical and transverse directions and are nondeformable upon receipt of axial pressure on tube 10. Second rigid members 35 are spaced between certain of the first rigid members 30 and form a rigid line along the length of tube 10. Second rigid members 35 are deformable, however, upon receipt of a predetermined amount of axial pressure on tube 10, whereby though tube 10 is initially rigid, once the predetermined pressure is applied thereto, second rigid members 35 deform and tube 10 experiences axial collapse. First, nondeformable, rigid members 30 limit the degree of collapse of tube 10, thus ensuring that adequate openness remains in the tube wall to permit the passage of adequate dye liquor therethrough for uniform dyeing of a yarn wound thereon. As illustrated in FIGS. 1, 2 and 3, an outer edge 36 of second deformable rigid members 35 is set back from the outer periphery of tube 10. If desired, however, all of the rigid members may present an outer edge coincident with the outer periphery of tube 10 whereby no filter paper may be necessary to avoid yarn entrapment.

As particularly illustrated in FIG. 2, once the predetermined amount of axial pressure has been applied to tube 10, second rigid members 35 deflect and permit tube collapse.

Since the dye tube of the present invention is primarily designed to be disposable after a single use, economics of manufacture are of prime importance. Injection molding of a suitable plastic composition is thus preferred for manufacture of the instant tube. All of the elements of tube 10 are thus preferably integral or of unitary construction. Lead 20 thus extends away from flange 12, following a helical path of a predetermined outside diameter, corresponding substantially to the outside diameter of flange 12. The helical configuration continues outwardly until lead 20 meets the next adjacent flange.

According to the tube embodiment shown in FIG. 1, a single lead 20 is provided. The figures show the various embodiments on the face only. Opposite sides of the tubes would have a like appearance as the front and are thus not shown to simplify the drawings. Likewise, a plurality of leads 20 having pitch in the same direction would assume an appearance of that shown in FIG. 1. Where plural leads 20 are employed, the individual leads originate at different locations around flange 12 and follow parallel paths along the length of tube 10. Perpendicular members 30 and 35 on a single lead tube are connected to adjacent passes of the lead whereas on a plural lead tube, members 30 and 35 are connected between separate, parallel, adjacent leads. It should further be pointed out that the tubes of the present invention are not restricted to only single or double leads, but any number of leads may be employed so long as the requisite qualities of the tube are met.

In the collapsed condition, note that lead 20 nearly abuts adjacent leads near the areas where members 30 are provided without rigid members 35 therebetween, leaving a plurality of openings 15 around the circumference and along the length of tubular element 10 to permit the flow of dyestuff from the inside of the dye spring 10 outwardly. Additionally in those areas where deformable axial members 35 are provided, lead 20 is held away from an adjacent segment by the approximate double thickness of member 35. The thickness of deformable axial member 35 can thus aid in determining the degree of collapse of tube 10.

Figure 4:
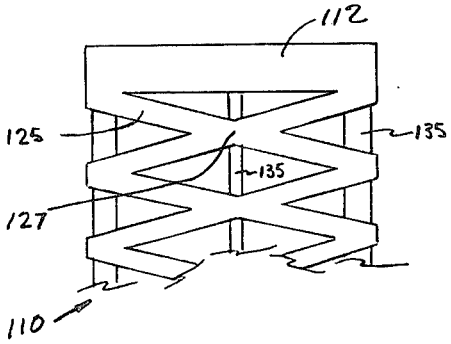
FIG. 4 is a partial side elevational view of a tube according to the present invention illustrating a further embodiment of same.

FIG. 4 illustrates another embodiment of the present invention when a dye tube 110 is provided having an end flange 112 from which a plurality of helical members 120 and 124 emanate, extending outwardly with opposite pitch and having points of intersection 127 along the length of tube 110. In a preferred embodiment the tube of the present invention is a unitary molded product and helical members 120 and 125 would thus be unitary at intersection points 127. Located between at least certain of the points of lead intersection 127 along a line axial to the length of the tube are deformable rigid members 135. Tube 110 is thus initially rigid, but will collapse upon receipt of sufficient axial pressure to deform members 135.

Figure 5:
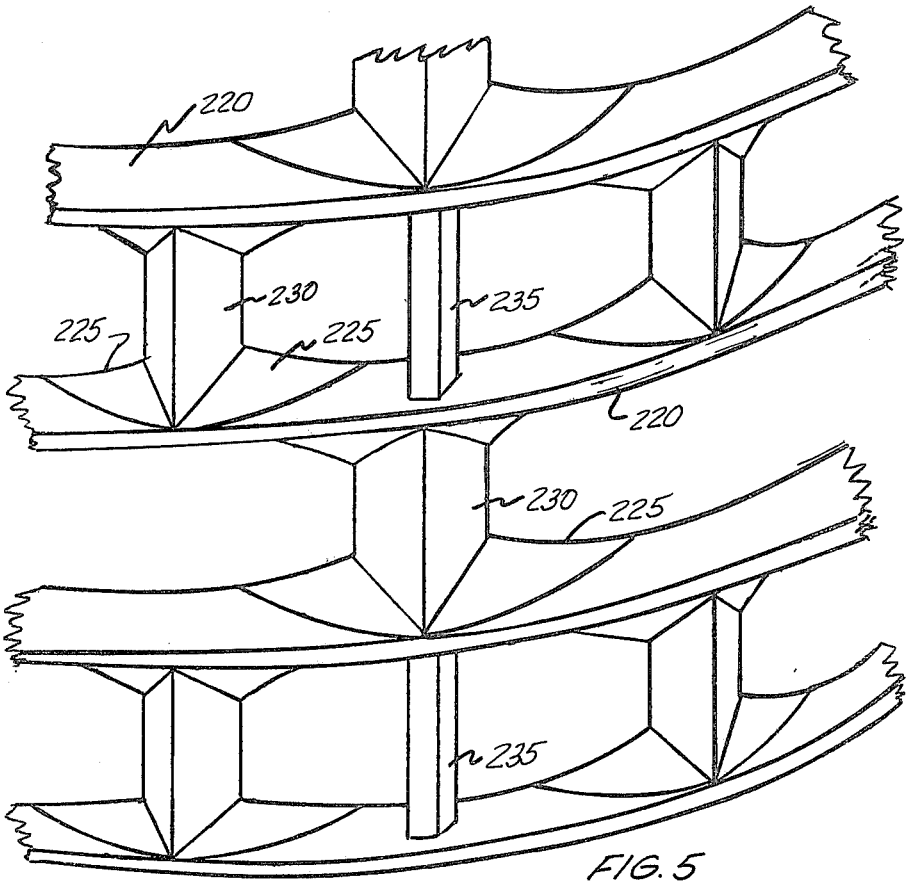
FIG. 5 is a partial isometric view of a tubular element according to the present invention showing a particular embodiment of helical members.

FIG. 5 illustrates a further embodiment of the present invention as shown in FIGS. 1 through 3. Leads 220 may be modified in thickness along predetermined portions of their lengths to better control the collapsibility characteristics of the dye tube. As shown in FIG. 5, leads 220 have members 230 and 235 angularly disposed with respect thereto in the same fashion as shown in FIGS. 1–3. Further material has been added by way of fillets 225 adjacent the junctions between members 230 and leads 220 on the sides thereof. As such, a thinner lead 220 may be employed while building up the area around members 230 whereby the collapsing characteristics of the dye tube are improved for the thinner lead. In this embodiment, members 230 are nondeformable under the predetermined axail pressure while members 235 are deformable under the same conditions.

Figure 6:
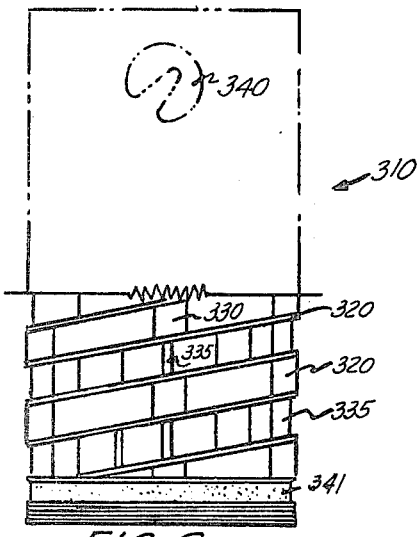
FIG. 6 is a partial side elevational view of a dye tube according to the present invention illustrating a further embodiment of same.

FIG. 6 illustrates the present invention for a tube for open end spinning. A dye tube 310 is provided having one or more leads 320 with nondeformable rigid members 330 and deformable rigid members 335 therealong. Tube 310 further has a yarn engaging member 340 located adjacent one end thereof to initiate winding of yarn therearound and a transfer tail receiving groove 341 located at an opposite end in which a yarn transfer tail may be produced. If desired, tube 310 may be collapsed by the application of the predetermined axial pressure thereon.

Figure 7:
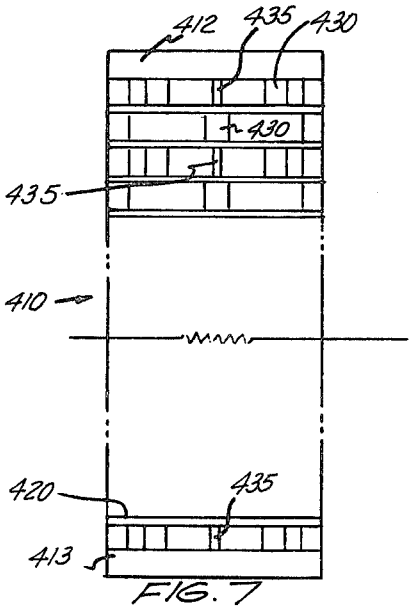
FIG. 7 is a partial side elevational view of yet another embodiment of the tubular element of the present invention.

In FIG. 7, a dye tube 410 is partially illustrated having end flanges 412 and 413 with a plurality of rings 420 located therebetween. First, nondeformable rigid members 430 are secured at opposite ends to a flange and/or a ring to unify the structure of the tube, with the first rigid members 430 being spaced apart from each other in both axial and circumferential directions. Second, deformable rigid members, 435 are further secured at opposite ends to a flange and/or a ring, and where located, cooperate with the first rigid members to define axially extending rigid sections along the length of tube 410. In like fashion to other embodiments described herein, tube 410 is initially rigid and collapses when sufficient pressure is exerted thereon to deform rigid members 435. Also outer edges the rigid members 430 and 435 are coterminous with the outer periphery of tube 410 whereby when provided in sufficient number, no filter paper is required to avoid entrapment of a yarn wound thereon during tube collapse.

Figure 8:
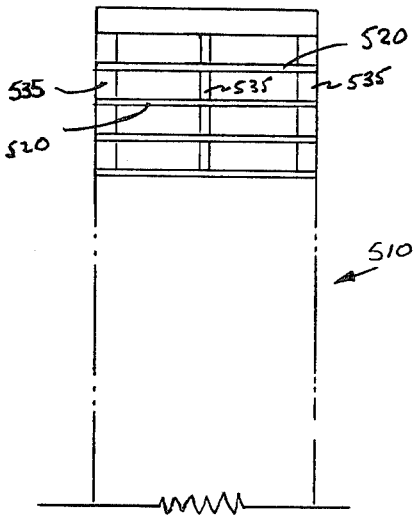
FIGS. 8 and 9 are partial side elevational views of further embodiments of the present invention.
Figure 9:
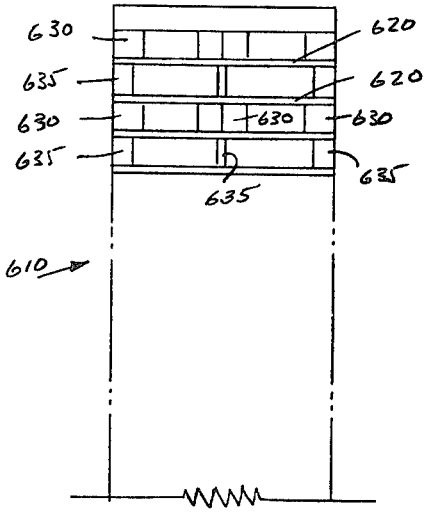

FIG. 8 illustrates a dye tube 510 where only deformable rigid members are secured between rings 520. In this embodiment the outer thickness of rigid members 535 determines the degree of tube collapse. In FIG. 9, a dye tube 610 is shown where alternating groups of nondeformable rigid members 630 and deformable rigid members 635 are secured between adjacent rings 620 along the length of tube 610.

Figure 10:
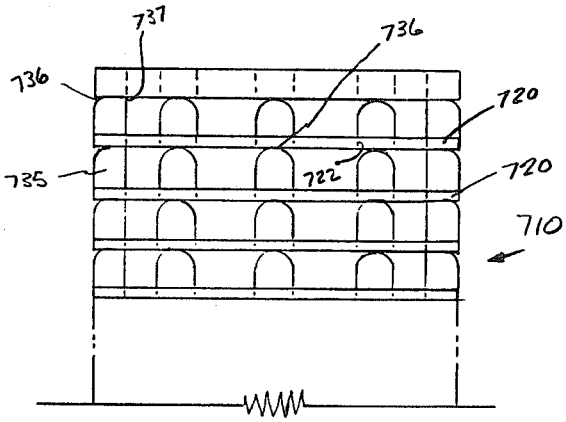
FIG. 10 is a partial side elevational view of a tube according to the present invention illustrating an embodiment of deformable rigid member according to the present invention.
Figure 11:
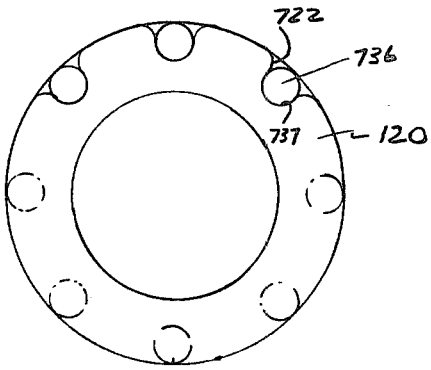
FIG. 11 is a cross sectional view of the tube shown in FIG. 10, taken along a line XI—XI.
Figure 12:
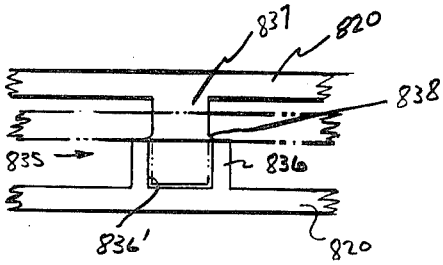
FIG. 12 is a partial side elevational view of yet a further embodiment of deformable rigid members according to the present invention.

FIGS. 10 through 12 illustrate a further embodiment of the present invention as to the deformable rigid members. In FIG. 10 a portion of a dye tube 710 is shown having a plurality of rings 720 with deformable rigid members 735 secured therebetween. Rings 720 have a plurality of rigid member receiving areas therearound, illustrated by notches 722. Adjacent each notch 722 is an end 736 of a deformable rigid member 735 with member 735 being secured to ring 720 by a thin section of material 737 around notch 722. Tube 710 would thus initially be rigid along its length. When a predetermined amount of axial pressure is provided on tube 710, section rigid member 735 will rupture at section 737 and move into notch 722, thus reducing the length of tube 710. A similar arrangement is illustrated in FIG. 12 where the solid lines indicate a rigid tube structure and the broken lines a collapsed tube. Two rings 820 are shown having a deformable rigid member 835 secured therebetween. Rigid member 835 being of unitary construction with slotted element 836 at a top 838 of a slot 836' defined thereby. Initially therefore, a rigid tube is provided with rupture occurring around post 837 at the top 838 of slot 836' when sufficient axial pressure is applied in the dye tube.

As mentioned above, it is preferred that the tubular elements of the present invention be integral, resulting from injection molding of a plastic composition so as to provide the dye tube with desired shape and dimensions. Furthermore, as stated above, a desired material when the tubular member is utilized as a dye tube is a plastic composition such as a polypropylene that will withstand the dyeing temperatures experienced, somewhere in the neighborhood of 280° to 300° F. Insofar as ultimate use is concerned, however, the tubular elements of the present invention may also be employed as shock absorbers, springs, and the like. Moreover, the embodiments discussed herein and portions thereof may be interchangeably used with all of the dye tubes according to the present invention.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. An improved yarn carrier comprising:

(a) a pair of annular end flanges; and (b) an intermediate structure located between said annular end flanges, said intermediate structure comprising at least one flexible member extending generally transverse to the length of the carrier, a plurality of first non-deformable rigid members provided along the length of the intermediate structure and extending generally axially to the length of the carrier, said first non-deformable rigid members being spaced apart from other first non-deformable members in all directions, and a plurality of second initially rigid members disposed among said first rigid members and extending generally axially to the length of the carrier, said members being united to define an initially rigid structure having an open network for passage of dye liquor therethrough, said second initially rigid members having a width dimension at an outer edge of said carrier less than a depth dimension transverse to the length of said carrier whereby upon receipt of a predetermined amount of axial force on said carrier, said second initially rigid members deform in a direction generally circumferentially with respect to said carrier permitting partial collapse of said carrier.

2. An improved yarn carrier as defined in claim 1 wherein said at least one generally transverse extending member is a helical member.

3. An improved yarn carrier as defined in claim 2 wherein a plurality of helical members are present in said structure.

4. An improved yarn carrier as defined in claim 1 wherein said generally transverse extending member comprises at least two helical members, one of said helical members having a pitch opposite the other of said helical members.

5. An improved yarn carrier as defined in claim 1 wherein said at least one generally transverse extending member comprises a plurality of rings spaced apart in an axial direction with respect to the length of the carrier.

6. An improved yarn carrier as defined in claim 5 wherein said first and second rigid axially extending members are connected between adjacent rings.

7. An improved yarn carrier as defined in claim 1 wherein said at least one transverse extending member is a helical member secured at opposite ends to said annular end flanges and where said first and second rigid members are secured at opposite ends to portions of said helical member.

8. An improved yarn carrier as defined in claim 1 wherein said second rigid members are located between first rigid members.

9. An improved yarn carrier comprising:

(a) a pair of annular end flanges;

(b) at least one helical member secured to said flanges at opposite ends thereof; and (c) a plurality of rigid members secured to said at least one helical member along the length of same, defining an initially rigid structure, said rigid members being generally rectangular in shape and having a width dimension of an outer edge of said carrier less than a depth dimension transverse to the length of said carrier whereby upon receipt of a predetermined amount of force in a direction axial to the length of the carrier at least certain of said rigid members deform in a generally circumferential direction with respect to said carrier, and permit partial axial collapse of said carrier.

10. An improved yarn carrier as defined in claim 9 further comprising rigid members that are not deformable by said predetermined axial force, said nondeformable rigid members being separated in both helical and axial directions.

11. An improved yarn carrier as defined in claim 9 wherein a plurality of helical members are secured between said annular end flanges, certain of said helical members having a pitch opposite that of other of said helical members.

12. An improved yarn carrier comprising:

(a) a plurality of rings;

(b) a plurality of first rigid members secured between said rings and extending generally axial to the length of the carrier, said first rigid members being spaced apart from each adjacent first rigid member; and (c) a plurality of second initially rigid members secured between said rings along the length of said carrier, said rings and first and second rigid members defining a carrier having an open network therealong for the passage of dye liquor therethrough, said second rigid members having a width dimension at an outer edge of said carrier less than a depth dimension transverse to the length of said carrier whereby said second rigid members only being deformable in a direction generally circumferentially with respect to said carrier upon receipt of a predetermined amount of force axial to the length of the carrier whereupon said carrier will experience partial axial collapse.

13. An improved yarn carrier comprising:

(a) a plurality of rings;

(b) a plurality of rigid members secured to said rings at opposite ends of same, said rigid members being spaced apart from adjacent rigid members in axial and circumferential directions, said rigid members being generally rectangular in shape and having a width dimension at an outer edge less than a depth dimension transverse to the length of the carrier whereby upon receipt of a predetermined force in a direction axial to the length of the carrier at least certain of said rigid members deflect in a directon generally circumferential with respect to said carrier.

14. An improved yarn carrier comprising:

(a) a pair of annular end flanges;

(b) an intermediate structure located between said flanges and comprising at least one member extending in a direction generally transverse to the length of the carrier, each generally transverse member defining a plurality of axial member receiving areas thereon; and (c) a plurality of rigid members extending axially with respect to the length of the carrier and being secured at one end to a generally transverse extending member and at an opposite end at an axial member receiving area, said axial rigid members having a lesser thickness at said connection with said receiving area whereby upon receipt of a predetermined force axial to the length of the carrier, said axially extending members rupture at said lesser thickness and move into said areas causing axial collapse of said carrier.

15. An improved yarn carrier as defined in claim 14 wherein said axial member receiving areas extend axially outwardly from said generally transverse member.

16. An improved yarn carrier as defined in claim 14 wherein said at least one generally transversely extending member comprises a helical member.

17. An improved yarn carrier as defined in claim 14 wherein said at least one generally transversely extending member comprises a plurality of rings, said axial members being secured between adjacent rings.

18. An improved yarn carrier comprising:

(a) a pair of annular end flanges; and (b) an intermediate structure located between said annular end flanges, said intermediate structure comprising at least one member extending generally tansverse to the length of the carrier and a plurality of initially rigid members provided along the length of the intermediate structure and extending generally axially to the length of the carrier, said members being united to form an initially rigid open network for the passage of dye liquor therethrough, at least certain of said rigid members having a width dimension at an edge of said carrier less than a depth dimension transverse to the length of the carrier and deforming in a direction generally circumferentially with respect to said carrier upon receipt of a predetermined amount of axial force with respect to the length of said carrier and other of said rigid members rupturing upon receipt of said axial force permitting partial collapse of said carrier.

* * * * *